US009622551B2

(12) United States Patent
Gonda et al.

(10) Patent No.: US 9,622,551 B2
(45) Date of Patent: Apr. 18, 2017

(54) METHOD OF MANUFACTURING PORTION OF SLIDE FASTENER

(71) Applicant: YKK Corporation, Tokyo (JP)

(72) Inventors: Eiji Gonda, Cheshire (GB); Steven Thomas, Cheshire (GB)

(73) Assignee: YKK Corporation (JP)

( * ) Notice: Subject to any disclaimer, the term of this patent is extended or adjusted under 35 U.S.C. 154(b) by 13 days.

(21) Appl. No.: 14/297,588

(22) Filed: Jun. 5, 2014

(65) Prior Publication Data

US 2014/0359979 A1 Dec. 11, 2014

(30) Foreign Application Priority Data

Jun. 7, 2013 (GB) ..... 1310165.4

(51) Int. Cl.

*A44B 19/32* (2006.01)
*D05B 23/00* (2006.01)
*A44B 19/34* (2006.01)

(52) U.S. Cl.

CPC ..... *A44B 19/32* (2013.01); *A44B 19/34* (2013.01); *Y10T 24/2561* (2015.01); *Y10T 29/49782* (2015.01)

(58) Field of Classification Search

CPC ..... A44B 19/32; A44B 19/34; Y10T 24/2514; Y10T 24/2505; Y10T 29/49782; Y10T 24/2561

USPC ..... 112/475.14, 475.16; 24/384, 389, 403

See application file for complete search history.

(56) References Cited

U.S. PATENT DOCUMENTS 2,602,208 A * 7/1952 Gossner ..... A44B 19/32 24/389
3,924,305 A 12/1975 Hamamura
4,601,085 A * 7/1986 Yoshida ..... A44B 19/32 24/384
4,607,416 A * 8/1986 Tanikawa ..... A44B 19/32 24/384
4,724,586 A * 2/1988 Tsubokawa ..... A44B 19/32 24/384

(Continued)

FOREIGN PATENT DOCUMENTS

EP 1150586 B1 4/2007
WO 2012/120602 A1 9/2012

OTHER PUBLICATIONS

Search Report, British Patent Application No. 1310165.4, mailed Nov. 26, 2013.

(Continued)

*Primary Examiner* — Robert J Sandy
*Assistant Examiner* — Rowland Do
(74) *Attorney, Agent, or Firm* — Kilpatrick Townsend & Stockton LLP

(57) ABSTRACT

A first tape having a first edge is provided. The first tape is provided with a row of coupling elements along the first edge of the first tape. The coupling elements are configured to interdigitate with a further row of coupling elements. A first layer of a fluid resistant material is attached to the first tape. An extending layer of a fluid resistant material is attached to the first layer. The extending layer forms an extension member including a first overhang portion which extends beyond a second edge opposite the first edge. The first layer of the fluid resistant material is attached to the first tape and the extending layer is attached to the first layer.

18 Claims, 5 Drawing Sheets

(56) References Cited

U.S. PATENT DOCUMENTS

| | | | | | |
|---|---|---|---|---|---|
| 4,744,133 | A * | 5/1988 | Tsubata | A44B 19/32 | 24/389 |
| 5,351,369 | A * | 10/1994 | Swain | B65D 33/2541 | 24/304 |
| 5,386,616 | A * | 2/1995 | Norvell | A44B 19/32 | 24/384 |
| 5,924,172 | A * | 7/1999 | Klein | A44B 19/32 | 2/96 |
| 6,582,824 | B1 * | 6/2003 | Weigl | B60R 13/04 | 428/413 |
| 2002/0121005 | A1 | 9/2002 | Dawson | | |
| 2002/0189006 | A1 | 12/2002 | Hexels | | |
| 2005/0183247 | A1 | 8/2005 | Berns | | |
| 2006/0282995 | A1 * | 12/2006 | Liou | A44B 19/32 | 24/389 |
| 2008/0040837 | A1 * | 2/2008 | King | A41D 13/012 | 2/227 |
| 2008/0189918 | A1 * | 8/2008 | Kusayama | A44B 19/32 | 24/389 |
| 2010/0093878 | A1 * | 4/2010 | Yang | C08F 24/00 | 521/27 |
| 2013/0014355 | A1 * | 1/2013 | Lee | A44B 19/32 | 24/389 |
| 2013/0125352 | A1 * | 5/2013 | Chou | A44B 19/32 | 24/389 |

OTHER PUBLICATIONS

Office Action, Chinese Patent Application No. 201410251397.1, mailed Dec. 15, 2016.

* cited by examiner

METHOD OF MANUFACTURING PORTION OF SLIDE FASTENER

The present application claims priority to GB Application No. 1310165.4 filed Jun. 7, 2013, which is incorporated herein by reference.

TECHNICAL FIELD

The present invention relates to a slide fastener and method of manufacture of a portion thereof. In particular the slide fastener may be a fluid resistant slide fastener and the manufactured portion of slide fastener may be a portion of a fluid resistant slide fastener.

BACKGROUND

Known slide fasteners (also referred to as zip fasteners) are generally constructed as follows.

Coupling elements (also referred to as teeth) are attached to the edge of a tape to form a stringer. The tape is usually woven or knitted and may be formed from, for example, polyester. The coupling elements are attached to the tape by, for example, crimping or moulding the coupling elements onto a reinforced edge of the tape. Alternatively, the coupling elements may be formed as a continuous coil. In this case the coupling elements are most commonly woven or knitted into the tape or alternatively are stitched to a surface of the tape at the edge of the tape.

Two stringers are brought together, such that the coupling elements of each stringer can attach to one another, for example, by interdigitating, to form chain. A slider is attached to the chain such that it can move along the chain between the two stringers. The slider commonly includes a main body through which the coupling elements of each stringer pass and pull tab attached to the main body which may be grasped by a user in order to effect movement of the slider along the chain.

Movement of the slider along the chain in a first direction causes the coupling elements of the first stringer to attach to the coupling elements of the second stringer. Whereas movement of the slider along the chain in a second direction, opposite to the first direction, causes the coupling elements of the first stringer to detach from the coupling elements of the second stringer.

The chain is cut to a desired length to form a desired length of slide fastener. Stops (often referred to as top stops and bottom stops) are attached to either end of the chain. The stops limit the extent of movement that the slider can undertake along the chain.

Some slide fasteners, may have a single bottom stop which is attached to both the first and second stringers. Other slide fasteners, which may be referred to as a separating slide fasteners, may have two separate bottom stops attached to a corresponding one of the stringers. The two bottom stops may take the form of a retainer box and an insertion pin. The insertion pin can be inserted into the retainer box in order to attach the first and second stringers to one another. Conversely, the insertion pin can be removed from the retainer box in order to detach the first and second stringers from one another.

Some slide fasteners may have two separate top stops attached to a corresponding one of the stringers. Other slide fasteners may have a single top stop attached to both of the stringers.

In certain applications it is desirable for a slide fastener to be fluid resistant, for example liquid and/or gas tight (i.e. for the slide fastener to substantially prevent the passage of liquid and/or gas through the slide fastener when the slide fastener is in a closed configuration). By further way of example, in some applications, it is desirable for a slide fastener to be waterproof, or more specifically, for an article (for example, but not limited to, a garment) of which a waterproof slide fastener forms part to be waterproof when the slide fastener is in a closed configuration.

The applicant has realised there is a requirement for a durable fluid resistant slide fastener.

It is common for slide fasteners to be secured to articles by stitching. Stitching provides a durable attachment between the slide fastener and the article to which the slide fastener is attached. The applicant has realised that a problem exists when trying to attach a fluid resistant slide fastener to an article in this manner whilst maintaining a substantially liquid and/or gas tight seal between the slide fastener and the article. For example, the holes created by stitching which pass through a slide fastener and an article to which the slide fastener is attached, and/or the stitching itself may create a fluid flow path via which fluid can flow, thereby making the slide fastener and article to which the slide fastener is attached undesirably fluid permeable.

Methods other than stitching, for example adhesives or other means of bonding, are known for attaching slide fasteners to an article. However, depending on the application of the slide fastener and/or article, the use of securing means other than stitching may not be suitably durable.

The width of known slide fasteners is defined by size and/or position of the coupling elements and the widths of the tapes. It is desirable for slide fasteners to have greater flexibility as to their width such that slide fasteners can easily be produced with different widths dependent on the width of slide fastener required by an article to which the slide fastener is to be applied.

SUMMARY

The present invention is concerned with a slide fastener stringer, a slide fastener and a method of producing at least a portion of a slide fastener which is fluid resistant and which can be attached to an article without creating a fluid flow path through the slide fastener and/or article. The present invention is also concerned with a slide fastener stringer, a slide fastener and a method of producing at least a portion of a slide fastener which enables greater flexibility in the widths of slide fastener which can be achieved. The present invention is also concerned with an alternative slide fastener, alternative slide fastener stringer and alternative method of producing at least a portion of a slide fastener. The slide fastener, slide faster stinger and method of producing at least a portion of a slide fastener according to the present invention seek to obviate or ameliorate problems with known slide fasteners and methods of manufacturing slide fasteners whether discussed above or otherwise.

According to a first aspect of the present invention, there is provided a method of manufacturing a portion of a slide fastener, the method comprising, providing a first tape having a first edge; providing the first tape with a row of coupling elements along the first edge of the first tape, the coupling elements being configured to interdigitate with a further row of coupling elements, attaching a first layer of a fluid resistant material to the first tape, attaching an extending layer of a fluid resistant material to the first layer, the extending layer forming an extension member comprising a first overhang portion which extends beyond a second edge of the first tape opposite the first edge of the first tape;

wherein the first layer of fluid resistant material is attached to the first tape and the extending layer is attached to the first layer such that there is no fluid path through the first layer and/or extending layer to the first tape.

The portion of a slide fastener may be a slide fastener stringer.

The first layer may be attached to the first tape such that at least a portion of the first tape is sandwiched within the first layer.

The extending layer may be attached to the first layer such that at least a portion of the first layer is sandwiched within the extending layer.

The portion of the slide fastener may comprise a first sealing portion which is configured to, when the coupling elements are interdigitated with the further row of coupling elements which form part of a further portion of slide fastener, co-operate with a further sealing portion of the further portion of slide fastener to form a fluid resistant seal which is configured to resist the passage of a fluid through the fluid resistant seal.

The first sealing portion may be configured such that the fluid resistant seal is configured to resist the passage of a fluid through the fluid resistant seal either to the interdigitated coupling elements or through the interdigitated coupling elements.

The first layer may comprise a first sealing portion which overhangs the coupling elements along the first edge of the first tape, the first sealing portion being configured to cooperate with a further sealing portion of a further portion of slide fastener to form a fluid resistant seal which is configured to resist the passage of a fluid through the fluid resistant seal to the coupling elements along the first edge of the first tape.

The method may further comprise providing a second tape having a first edge; providing the second tape with a row of coupling elements along the first edge of the second tape, the coupling elements being configured to interdigitate with a further row of coupling elements; attaching a second layer of a liquid resistant material to the second tape; and attaching the extending layer to the second layer, the extending layer forming the extension member, the extension member comprising a second overhang portion which extends beyond a second edge of the second tape opposite the first edge of the second tape; wherein the second layer of fluid resistant material is attached to the second tape and the extending layer is attached to the second layer such that there is no fluid path through the second layer and/or extending layer to the second tape.

The further row of coupling elements with which the row of coupling elements along the first edge of the second tape may be configured to interdigitate is the row of coupling elements along the first edge of the first tape.

The second layer may be attached to the second tape such that at least a portion of the second tape is sandwiched within the second layer.

The extending layer may be attached to the second layer such that at least a portion of the second layer is sandwiched within the extending layer.

The second tape, and second layer may form part of a second stringer. The second stringer may comprise a second sealing portion which is configured to, when the coupling elements of the second tape are interdigitated with the further row of coupling elements which form part of a further portion of slide fastener, co-operate with a further sealing portion of the further portion of slide fastener to form a fluid resistant seal which is configured to resist the passage of a fluid through the fluid resistant seal.

The second sealing portion may be configured such that the fluid resistant seal is configured to resist the passage of a fluid through the fluid resistant seal either to the interdigitated coupling elements or through the interdigitated coupling elements.

The second sealing portion may be configured to, when the coupling elements of the second tape are interdigitated with the row of coupling elements along the first edge of the first tape, co-operate with the first sealing portion to form a fluid resistant seal which is configured to resist the passage of a fluid through the fluid resistant seal.

The second sealing portion may be configured such that the fluid resistant seal is configured to resist the passage of a fluid through the fluid resistant seal either to the interdigitated coupling elements or through the interdigitated coupling elements.

The second layer may comprise a second sealing portion which overhangs the coupling elements of the first edge of the second tape, the second sealing portion being configured to cooperate with a further sealing portion of a further portion of slide fastener to form a fluid resistant seal which is configured to resist the passage of a fluid through the fluid resistant seal to the coupling elements of the first edge of the second tape.

The first sealing portion may be configured to cooperate with the second sealing portion to form a fluid resistant seal which is configured to resist the passage of a fluid through the fluid resistant seal to the coupling elements of the first edge of the first tape and the coupling elements of the first edge of the second tape.

The method may further comprise separating the extension member into first and second portions, wherein the first portion includes the first overhang portion, and the second portion includes the second overhang portion.

The first portion of the extension member may form part of a first slide fastener stringer and the second portion of the extension member forms part of a second slide fastener stringer.

The first slide fastener stringer and the second slide fastener stringer may form part of a slide fastener chain.

According to a second aspect of the invention there is provided a slide fastener including a portion manufactured according to the method of the first aspect of the invention.

According to a third aspect of the invention there is provided a slide fastener stringer comprising a first tape having a row of coupling elements along a first edge of the first tape, the coupling elements being configured to interdigitate with a further row of coupling elements, a first layer of a fluid resistant material attached to the first tape, an extending layer of a fluid resistant material attached to the first layer, wherein the extending layer forms an extension member comprising a first overhang portion which extends beyond a second edge of the first tape opposite the first edge of the first tape; and wherein the first layer of fluid resistant material is attached to the first tape and the extending layer is attached to the first layer such that there is no fluid path through the first layer and/or extending layer to the first tape.

The first layer may be attached to the first tape such that at least a portion of the first tape is sandwiched within the first layer.

The extending layer may be attached to the first layer such that at least a portion of the first layer is sandwiched within the extending layer.

The stringer may comprise a first sealing portion which is configured to, when the coupling elements are interdigitated with the further row of coupling elements which form part of a second stringer, co-operate with a further sealing portion of the second stringer to form a fluid resistant seal which is configured to resist the passage of a fluid through the fluid resistant seal.

The first sealing portion may be configured such that the fluid resistant seal is configured to resist the passage of a fluid through the fluid resistant seal either to the interdigitated coupling elements or through the interdigitated coupling elements.

The first layer may comprise a sealing portion which overhangs the coupling elements along the first edge of the first tape, the sealing portion being configured to cooperate with a further sealing portion of a further portion of slide fastener to form a fluid resistant seal which is configured to resist the passage of a fluid through the fluid resistant seal to the coupling elements along the first edge of the first tape.

According to a fourth aspect of the invention there is provided a slide fastener comprising one or two stringers according the third aspect of the invention.

The slide fastener may comprise first and second stringers according to the third aspect of the invention, wherein the first stringer comprises a first sealing portion and the second stringer comprises a second sealing portion, the first and second sealing portions being configured to, when the coupling elements of the first and second stringers are interdigitated, co-operate to form a fluid resistant seal which is configured to resist the passage of a fluid through the fluid resistant seal.

The first and second sealing portions may be configured such that the fluid resistant seal is configured to resist the passage of a fluid through the fluid resistant seal either to the interdigitated coupling elements or through the interdigitated coupling elements.

The slide fastener may comprise first and second stringers according to the third aspect of the invention, wherein the first layer of the first stringer comprises a first sealing portion which overhangs the coupling elements along the first edge of the first tape of the first stringer, wherein a first layer of the second stringer comprises a second sealing portion which overhangs coupling elements along a first edge of a second tape of the second stringer, and wherein the first and second sealing portions are configured to cooperate to form a fluid resistant seal which is configured to resist the passage of a fluid through the fluid resistant seal to the coupling elements along the first edge of the first tape of the first stringer and the second stringer.

The slide fastener may be fluid resistant.

The slide fastener may be at least one of substantially gas tight and substantially liquid tight.

Slide fasteners according to the present invention find particular application in waterproof garments and garments used in outdoor pursuits, for example, walking clothes, diving suits etc. Slide fasteners according to the present invention also find application in waterproof articles, for example, tents and life-rafts. However, it will be appreciated that slide fasteners according to the present invention are not limited to these uses.

Other aspects and preferred features of the present invention will be apparent from the following description and the accompanying claims.

BRIEF DESCRIPTION OF THE DRAWINGS

The invention will now be further described by way of example and with reference to the accompanying drawings, in which.

EMBODIMENTS

Figure 1A:
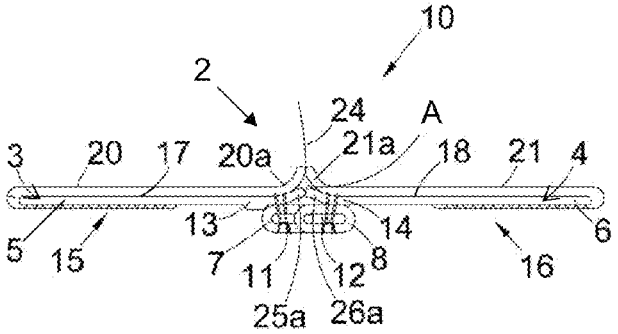
Fig. 1a (Prior Art)
FIG. 1*a* shows a schematic cross-section through a portion of a known slide fastener.
Figure 1B:
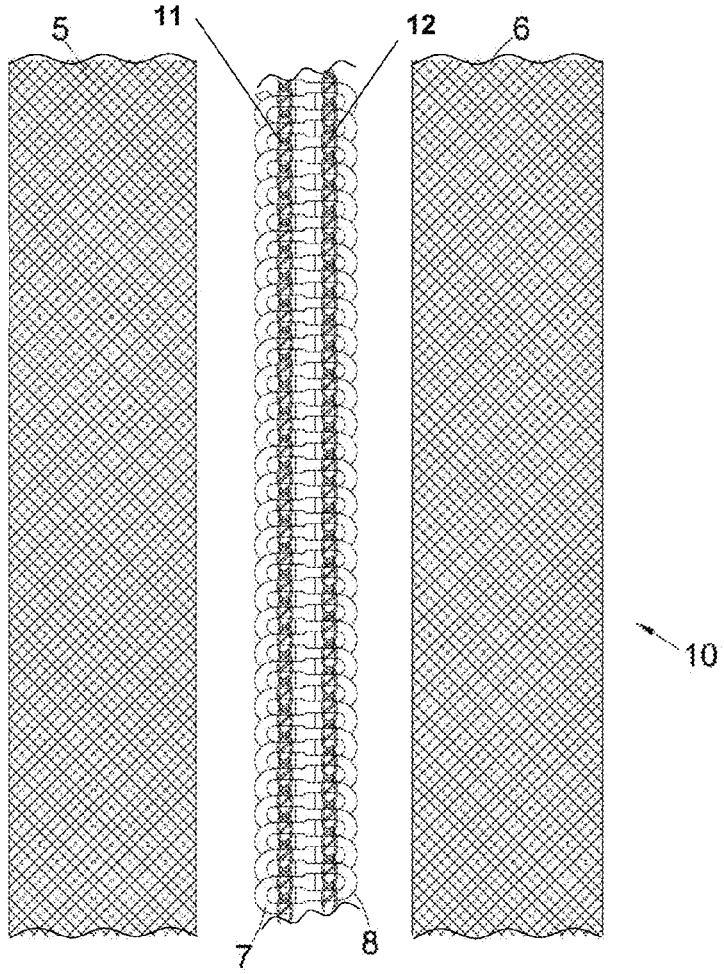
Fig. 1b Prior Art
FIG. 1*b* shows a schematic plan view of a portion of the slide fastener shown in FIG. 1*a;*

FIGS. 1*a* and 1*b* show a known slide fastener 10 of the general type described in EP1150586, the entire contents of which are incorporated herein by reference.

The slide fastener 10 comprises a chain 2 formed from two stringers 3, 4. Each stringer comprises a tape 5, 6 made from a woven fabric such as for example polyester. Continuous coil-shaped elements comprising coupling elements 7, 8 is stitched with threads 11, 12 or woven into the edge 13, 14 of each tape 5, 6, as is well known in the art. As shown most clearly in FIG. 1*a*, the continuous coil-shaped elements comprising coupling elements 7, 8 are mounted on an underside 15, 16 of each tape 5, 6 at a side of inner edge thereof, respectively. Portions of the tapes 5, 6 adjacent the coupling elements 7, 8 are not shown in FIG. 1*b* so as to enhance the clarity of the figure.

A layer of thermoplastic material 20, 21 is extruded onto an upper surface 17, 18 of each tape 5, 6, the upper surfaces 17, 18 of each tape 5, 6 being opposite the undersides 15, 16 of each tape 5, 6. The layer of thermoplastic material 20, 21 extends around the outer edge of each tape 5, 6, which is opposite the inner edge, and along a portion of the underside 15, 16 of each tape 5, 6. As shown in FIG. 1*a*, there are gaps on the undersides 15, 16 between the layers of thermoplastic material 20, 21 and the coupling elements 7, 8 so that portions of the undersides 15, 16 of each tape 5, 6 are exposed due to the gaps.

In order to produce a slide fastener from the chain 2 a slider (not shown) is mounted to the chain 2 for opening and closing the chain by selectively coupling or uncoupling the coupling elements 7, 8 (and hence the stringers 3, 4). In addition, it is usual to have end stops (again, not shown) located at either end of the slide fastener to limit the movement of the slider along the slide fastener. Sliders and end stops are well known in the art and will not be discussed in further detail here.

The slide fastener 10 is impermeable to fluid, that is, it is gas impermeable and waterproof. In use, the layers of thermoplastic material 20, 21 form a fluid tight/waterproof membrane and abut each other at a plane 24, located perpendicularly to the plane of the tapes 5, 6.

It is usual for the thermoplastic material layers 20, 21 to be applied to each stringer 3, 4 individually. The thermoplastic material layers 20, 21 form sealing lips 20*a*, 21*a* (also referred to as sealing fins), which extend laterally beyond the inner edges 25*a*, 26*a* of the tapes 5, 6 and over the coupling elements 7, 8. The sealing lips 20*a*, 21*a* extend upwardly at an angle to the plane of the fastener tapes 5, 6 and abut to form a raised area A that is raised above the general plane of the stringers 3, 4, to form an inverted V or triangular shape when the stringers are joined by the coupling of the coupling elements 7,8.

A problem associated with known fluid-proof slide fasteners as shown in FIGS. 1*a* and 1*b* is discussed below.

Figure 2:
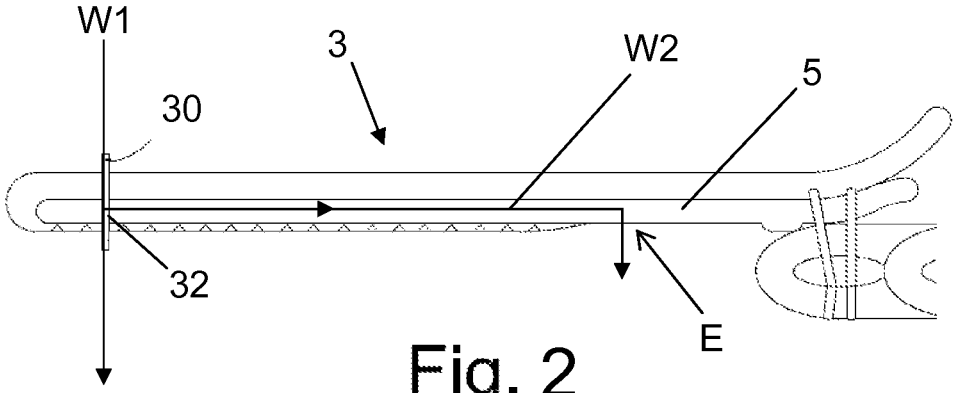
FIG. 2 shows a schematic cross-section through a portion of a stringer which forms part of the slide fastener shown in FIGS. 1*a* and 1*b;*

It may be necessary to secure the fastener to a garment or other article requiring fluid-proof characteristics. The usual mechanism by which the zip fastener is secured to the garment for example is by sewing as seen in FIG. 2. Unfortunately, the sewing process causes holes 32 to be generated in the stringers of the fastener which may allow the ingress of water along a path W1 created by sewing threads 30.

In addition the sewing thread 30 and holes 32 may create a second flow path W2 which allows the ingress of water. In the case of flow path W2 the water may flow along the sewing thread 30 and/or through the holes 32 and then into the tape 5. The water can then flow along the tape and exit at point E on the inside of the garment or article of which the slide fastener forms part.

Figure 3:
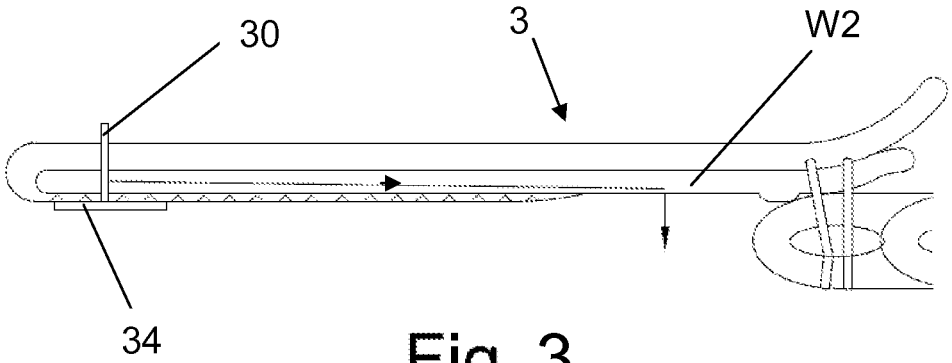
FIG. 3 shows the schematic cross-section of FIG. 2, with the addition of a backing material.

In order to try and avoid the holes formed in the sewing process from serving as a track for the ingress of fluid as seen in FIG. 2, a waterproof backing material 34, as shown in FIG. 3 may be applied to the underside of the fastener stringer 3 or directly on the sewing thread 30. However, as can be seen in FIG. 3, the application of a waterproof backing material does not block the flow path W2 and hence the waterproof backing material 34 may not prevent the ingress of water.

In addition, the known slide fastener shown in FIGS. 1 to 3, which is produced using known methods, offers very little flexibility in the width of the slide fastener.

Different articles or garments to which a slide fastener is to be attached may require different widths of slide fastener. For example if the slide fastener is to be used to provide a fastening for a relatively wide opening in a garment or article, then a relatively wide slide fastener will be required compared to that which would be required in order to fasten a relatively narrow opening in a garment or article.

The width of known slide fasteners is defined by various factors including the size of the coupling elements, the position at which the coupling elements are secured to the tapes of each stringer, and the width of the tapes of each stringer. Consequently, if it is desired to alter the width of a known slide fastener (e.g. to tailor the slide fastener so that it is suitable for fastening a particular size of opening in a garment or other article), then it would be necessary to change at least one of the characteristics of the slide fastener mentioned above. Changing at least one of these characteristics of the slide fastener (for example, changing the width of the tapes, the size of the coupling elements or changing the positioning of the coupling elements on the tapes) may be a relatively complicated process which requires the use of different components of slide fastener (for example, different sized coupling elements and/or different widths of tape). Consequently, it may be relatively inconvenient to change the width of known slide fasteners. That is, known slide fasteners have relatively little flexibility in their width.

Figure 4:
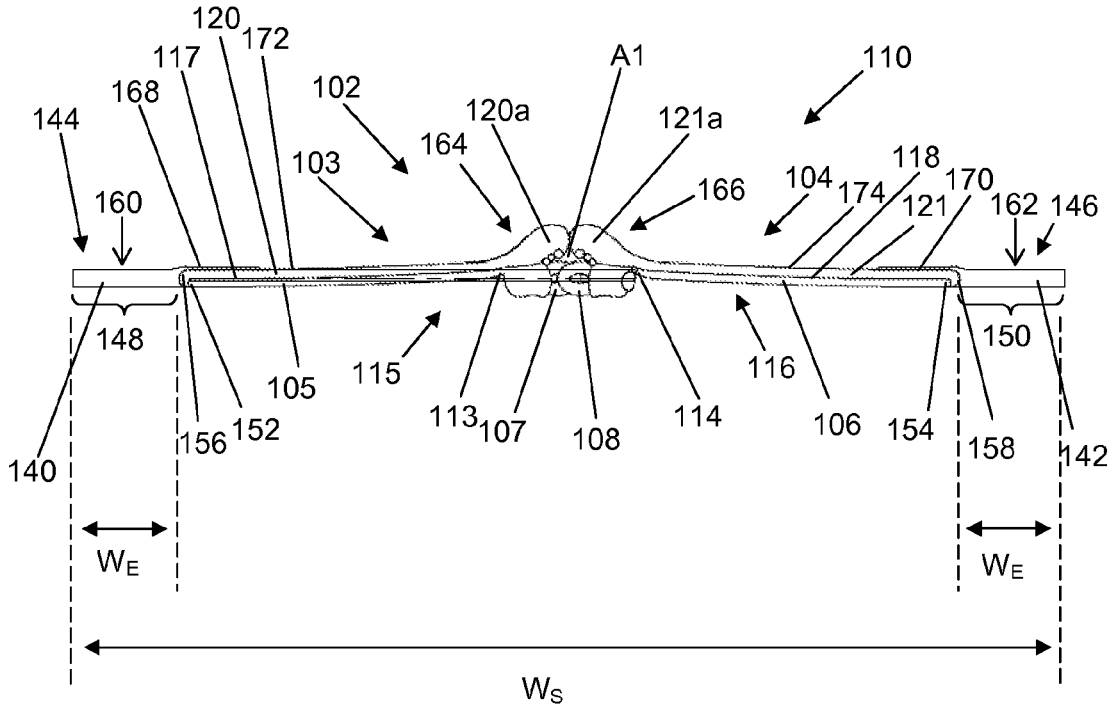
FIG. 4 shows a schematic cross-section through a portion of a slide fastener in accordance with the present invention.

FIG. 4 shows a cross-section through a slide fastener 110 according to an embodiment of the present invention which includes a chain 102 formed from two slide fastener stringers 103, 104 according to an embodiment of the present invention.

Each of the stringers 103 and 104 is substantially the same in this embodiment. However, in other embodiments, this may not be the case.

Within the following description, stringer 103 is referred to as the first stringer and stringer 104 is referred to as the second stringer. However, it will be appreciated that, equally, stringer 104 could be referred to as the first stringer and stringer 103 could be referred to the second stringer.

Each stringer 103, 104 comprises a tape 105, 106 having a row of coupling elements 107, 108 along a first edge 113, 114 of each tape 105, 106. The tape 105, 106 is made from a woven fabric such as, for example, polyester. However, it will be appreciated that in other embodiments the tapes 105, 106 may be made from any appropriate material.

The coupling elements 107, 108 of this embodiment are formed by two separate continuous coils which are stitched or woven to the edges 113, 114 of each tape 105, 106. However, it will be appreciated that in other embodiments, any appropriate coupling elements may be used and they may be attached to the respective edge of the respective tape by any appropriate method. The coupling elements 107, 108 are mounted on an underside 115, 116 of each tape 105, 106.

The coupling elements 107, 108 along the edge of each tape 105, 106 are configured to interdigitate with a further row of coupling elements. In this case, the coupling elements 107 of the first stringer 103 are configured to interdigitate with the coupling elements 108 of the second stringer 104.

A layer 120, 121 of fluid resistant material is attached to each tape 105, 106. In the present embodiment, the layer of fluid resistant material is a layer of thermoplastic material which is extruded onto an upper surface 117, 118 of each tape 105, 106, the upper surfaces 117, 118 of each tape 105, 106 being opposite the undersides 115, 116 of each tape 105, 106. In this case, the thermoplastic material which forms the layers 120, 121 is both substantially impermeable to gas and substantially impermeable to liquid. However, it will be appreciated that in other embodiments, any appropriate fluid resistant material may be used which may be impermeable to either gas or liquid, or may be impermeable to both gas and liquid. The layer of thermoplastic material 120, 121 extends around the outer edge of each tape 105, 106 to the undersides 115, 116. The layer 120, 121 is also referred to as a first layer.

An extending layer 140, 142 of a fluid resistant material is attached to the layer 120, 121. In this embodiment, the extending layer 140, 142 of each stringer 103, 104 is formed from a thermoplastic material which is extruded onto each layer 120, 121. This extrusion process is discussed in more detail further below. It will be appreciated that, in other embodiments, any appropriate method may be used to attach the extending layer 140, 142 to the layer 120, 121 provided that the extending layer 140, 142 is attached to the layer 120, 121 such that there is no fluid path through the layer 120, 121 and/or extending layer 140, 142 to the respective tape 105, 106. The thermoplastic material which forms the extending layer 140, 142 is a fluid resistant material in that it is impermeable to both liquid and gas. It will be appreciated that in other embodiments any appropriate material may be used to form the extending layer, providing it is fluid resistant. A material is said to be fluid resistant if it is substantially impermeable to liquid and/or gas. In the preferable example, the extending layer 140, 142 and the layer 120, 121 of the thermoplastic material may be made of the same material. The extending layer may be attached to the first layer at the side opposite to the first tape so as to protrude relative to the upper surface of the first layer. Consequently, on the upper surface of the first layer, the thickness of a portion of the first layer to which the extending layer is attached is greater than the thickness of the other portion of the first layer to which the extending layer is not attached. In addition, the extending layer may also be attached to the second layer at the side opposite to the second tape so as to protrude relative to the second surface of the second layer. Consequently, on the upper surface of the second layer, the thickness of a portion of the second layer to which the extending layer is attached is greater than the thickness of the other portion of the second layer to which the extending layer is not attached.

The extending layer 140, 142 forms an extension member 144, 146 comprising an overhang portion 148, 150 which extends beyond a second edge 152, 154 of the tape 105, 106 opposite to the first edge 113, 114 of the tape 105, 106. In fact, in this embodiment, the overhang portion 148, 150 extends beyond an edge 156, 158 of the first layer which is the edge of the layer 120, 121 which is spaced furthest from the respective coupling elements 107, 108.

The layer 120, 121 of fluid resistant material is attached to the tape 105, 106 and the extending layer 140, 142 is attached to the layer 120, 121 such that there is no fluid path through the layer 120, 121 and/or extending layer 140, 142 to the respective tape 105, 106.

In order to secure each stringer 103, 104 (and hence the slide fastener 110) to a garment or other article requiring fluid-proof characteristics, the stringers 103, 104 are each sewn to the garment or other article. The points 160 and 162 within FIG. 4 indicate where sewing thread (not shown) is passed through the extension member 144, 146 in order to sew the stringers 103, 104 (and hence the slide fastener 110) into the garment or other article so that the stringers 103, 104 (and hence slide fastener 110) are secured to the garment or other article. At the points 160 and 162 within FIG. 4, each stringer 103, 104 is formed only by the thermoplastic material of the extension member 144, 146 and the extension member 144, 146 is coupled to the first layer. Consequently, the fluid intruding with the sewing threads sewn to the extension member 144, 146 and/or the holes formed by sewing the sewing threads do not intrude into the tapes.

It can be seen that, because the holes (not shown) created by sewing the stringers 103, 104 (and hence slide fastener 110) into a garment or other article are created only within the extension member 144, 146, unlike known slide fasteners (as shown in FIGS. 1 to 3), no fluid flow path which allows the ingress of fluid is created via the respective tape 105, 106 of each stringer 103, 104. This is because the holes and thread used for sewing the slide fastener do not pass through the tapes 105, 106 of the stringers of the slide fastener. Consequently, when sewn to a garment or other article, the stringers of the present invention (which may form part of a slide fastener according to the present invention) do not provide a fluid flow path along which fluid can flow so as to penetrate the garment or other article via the tape. In order to prevent holes formed in the stringer during the sewing process from serving as a path for the ingress of fluid, a waterproof backing material may be applied to the underside of the stringer or directly on the sewing thread. The waterproof backing material has fluid-proof characteristics. For example, a resin film or a band to which the fluid-proof treatment is applied may be used as the waterproof backing material.

Consequently, the stringers according to the present invention (and hence slide fastener according to the present invention) are fluid-proof and improve the fluid resistance of a garment or other article to which the stringers (and hence slide fastener) are applied.

In addition, slide fasteners comprising at least one stringer according to the present invention have a greater flexibility as to their width compared to known slide fasteners. This because the width $W_E$ of the extension member can be readily changed whilst all other components of the slide fastener are kept constant so as to change the width $W_S$ of the slide fastener. The ability to use the same components of the slide fastener and only change the width of the extension member of a stringer so as to vary the total width of the slide fastener means that it is relatively simple to produce a slide fastener with any desired width by only changing the width of the extension member. This leads to a reduction in cost and complexity of creating slide fasteners with different widths suitable for different widths of opening within a garment or other article.

In order to produce a slide fastener from the chain 102 shown in FIG. 4, a slider (not shown) is mounted to the chain 102 for opening and closing the chain by selectively coupling or uncoupling the coupling elements 107, 108 (and hence the stringers 103, 104). In addition, end stops (again not shown) located at either end of the slide fastener may be used to limit the movement of the slider along the slide fastener. Sliders and end stops are well known in the art of slide fasteners and hence will not be discussed in any further detail here.

The slide fastener 110 is impermeable to fluid, that is, it is gas impermeable and liquid impermeable. In use, the layers 120, 121 form a fluid tight membrane. The layer 120, 121 of each stringer 103, 104 comprises a sealing portion 164, 166 which overhangs from the first edge 113, 114 in parallel with and along the first edge 113, 114 of the tape 105, 106. The sealing portions 164, 166 of each stringer 103, 104 are configured to cooperate with a further sealing portion of a further portion of slide fastener so as to form a fluid resistant seal which is configured to resist the passage of a fluid through the fluid resistant seal to the coupling elements 107, 108. In this case, the layer 120 of the stringer 103 comprises a sealing portion 164 which overhangs from the first edge 113 in parallel with and along the first edge 113 of the tape 105 of the stringer 103. Likewise, the layer 121 of the stringer 104 comprises a sealing portion 166 which overhangs from the first edge 114 in parallel with and along the first edge 114 of the tape 106 of the stringer 104. The first and second sealing portions 164 and 166 are configured to cooperate to form a fluid resistant seal which is configured to resist the passage of a fluid through the fluid resistant seal to the coupling elements 107, 108. That is, when the coupling elements 107, 108 are coupled to each other, the sealing portion 164 comes into contact with the sealing portion 166, thereby forming the fluid resistant seal.

At the sealing portions 164, 166 along the first edge 113, 114, the layers 120, 121 of each stringer 103, 104 form sealing lips 120*a* and 121*a* (also referred to as sealing fins) which come into contact with each other at the time of coupling of the coupling elements. The sealing lips 120*a*, 121*b* are beyond inner edges of the tapes 105, 106 and over the coupling elements 107, 108. The lips 120*a*, 121*a* abut at an angle to the plane of the fastener tapes 105, 106 and form a raised area A1 that is raised above the general plain of the stringers 103, 104 to form an inverted V or triangular shape when the stringers are joined by the coupling of the coupling elements 107, 108. It will be appreciated that, although within the present embodiment the sealing portion 164, 166 is integral with the respective layer 120, 121 of each stringer 103, 104, in other embodiments this need not be the case. For example, the sealing portion may be formed from a separate piece to the layer of the stringer. Likewise, any appropriate configuration of sealing portion which is configured to form a fluid resistant seal to resist the passage of fluid through the fluid resistant seal, for example to the coupling elements, or through the coupling elements may be used. For example, the sealing portions described above include sealing lips which form a seal above the coupling elements. In other embodiments the sealing portions may take any appropriate form.

In one example each coupling element may comprise an inner element and an outer element. For example, the inner element may be provided on the lower surface of the first tape and the outer element may be provided on the upper surface of the first tape, which is opposite to the lower surface and on the upper surface of the layer of the sealing material. A layer of sealing material which forms at least part of a sealing portion is located between the inner element and the outer element. In use coupling elements of a first stringer interdigitate with coupling elements of a second stringer such that the inner elements of the coupling elements of the first stringer interdigitate with the inner elements of the coupling elements of the second stringer in order to close the slide fastener chain. Closing the slide fastener chain by the interdigitation of the inner elements result in the sealing portion (e.g. layer of sealing material between the inner and outer elements) of the first stringer and the sealing portion (e.g. layer of sealing material between the inner and outer elements) of the second stringer to abut and be compressed between the outer elements of the first stringer and the outer elements of the second stringer to thereby create a seal.

In some embodiments the coupling elements of each stringer may comprise a first row of coupling elements on a first side of the tape of the stringer and a second row of elements on a second side of the tape of the stringer. At least one of the coupling elements of the first row of coupling elements and at least one of the coupling elements of the second row of coupling elements may be of unitary construction—that is to say that at least one of the coupling elements of the first row of coupling elements and at least one of the coupling elements of the second row of coupling elements may be one piece such that they are formed of a single piece of material. For example, each coupling element of the first row of coupling elements may be unitary with a coupling element of the second row of coupling elements.

The coupling elements of the stringer are all located at a first edge of the tape of the stringer.

A sealing portion is located between the first and second rows of coupling elements. In use coupling elements of a first stringer interdigitate with coupling elements of a second stringer such that the first row and second row of coupling elements of the first stringer interdigitate with the first row and second row of coupling elements of the second stringer in order to close the slide fastener chain. Closing the slide fastener chain by the interdigitation of coupling elements of the first and second stringers results in the sealing portion of the first stringer and the sealing portion of the second stringer to abut to thereby forming a seal.

In other embodiments the sealing portions may form part of the coupling elements such that it is the coupled coupling elements themselves which form a fluid resistant seal.

The sealing portions in the embodiment described above co-operate such that when the coupling elements of two stringers couple to one another, the sealing portions are drawn into contact to form a fluid resistant seal to resist the passage of fluid through the fluid resistant seal to the coupling elements or through the coupling elements. In other embodiments the sealing members of each stringer may be configured such that they can be brought into contact with one another (in order to form the fluid resistant seal) in a separate operation to the coupling elements of each stringer being coupled to one another.

The overhang portion 144, 146 of each stringer 103,104 may be said to extend beyond an edge of the layer 120, 121 which is opposite to the edge at which the sealing portions 164, 166 is located.

Within the presently described embodiment the layer of fluid resistant material 120, 121 which is attached to the tape 105, 106 is such that the layer of fluid resistant material extends around the outer edge of each tape 105, 106. In other embodiments, the layer of fluid resistant material may extend around the outer edge of each tape and along a portion of the underside of each tape. In this way, the layer may be attached to the tape such that at least a portion of the tape is sandwiched within the layer. The layer on the underside is formed with a gap between the layer and the coupling elements which are provided on the underside, and the tape is exposed between the layer and the coupling elements on the underside. The outer edge is an edge opposite to the first edge which is at a side at which the coupling elements are provided.

In the presently described embodiment the extending layer 140, 142 of each stringer 103, 104 is attached to the layer 120, 121 such that a portion 168, 170 of the extending layer 140, 142 extends over an upper surface 172, 174 of the layer 120, 121. The extending layer 140, 142 extends around the outer edge of each layer 120, 121. In other embodiments, the extending layer may extend around the outer edge of the first layer and along a portion of the underside of the first layer and/or first tape. That is to say, in other embodiments, the extending layer is attached to the first layer such that at least the portion of the first layer is sandwiched within the extending layer. The outer edge of the first layer is an edge opposite to the first edge which is at a side at which the coupling elements of the tape is provided, and the outer edge of the first layer is positioned close to an outer edge of the tape.

According to another aspect to the invention there is provided a method of manufacturing a portion of a slide fastener as discussed above. The portion of the slide fastener manufactured in accordance with the invention may be a slide fastener stringer. However, it would be appreciated that any portion of a slide fastener which is manufactured in accordance with this aspect of the invention falls within the scope of the present invention.

Referring to FIG. 4, the method of manufacturing a portion of a slide fastener according to a present invention comprises the following. A first tape 105 is provided, the tape 105 having a first edge 113. The tape 105 is provided with a row of coupling elements 107 along the first edge 113 of the tape 105. The coupling elements 107 are configured to interdigitate with a further row of coupling elements. In the example shown in FIG. 4, the coupling elements 107 are configured to interdigitate with the row of coupling elements 108 which form part of a separate stringer 104.

A layer 120 of a fluid resistant material is attached to the first tape 105.

An extending layer 140 of a fluid resistant material is attached to the layer 120. The extending layer 140 forms an extension member 144 comprising a first overhang portion 148 which extends beyond a second edge 152 of the first tape 105 opposite the first edge 113 of the first tape 105.

The layer 120 of fluid resistant material is attached to the first tape 105 and the extending layer 140 is attached to the layer 120 such that there is substantially no fluid path through the layer 120 and/or extending layer 140 to the first tape 105. The extending layer 140 can be made of only the thermoplastic resin.

The advantages of manufacturing a portion of the slide fastener in this manner have already been discussed above in relation to a slide fastener stringer in accordance with the present invention. As such repetition of these advantages is not made here.

Again referring to FIG. 4, method of manufacturing a portion of a slide fastener may further include the following.

A second tape 106 is provided, the second tape 106 having a first edge 114. The second tape 106 is provided with a row of coupling elements 108 along the first edge 114 of the second tape 106. The coupling elements 108 are configured to interdigitate with a further row of coupling elements. In this case, the coupling elements are configured to interdigitate with the row of coupling elements 107 which form part of the stringer 103. That is to say the row of coupling elements 108 along the first edge 114 of the second tape 106 is configured to interdigitate with the row of coupling elements 107 along the first edge 113 of the first tape 105.

A second layer 121 of a liquid resistant material is attached to the second tape 106.

Figure 5:
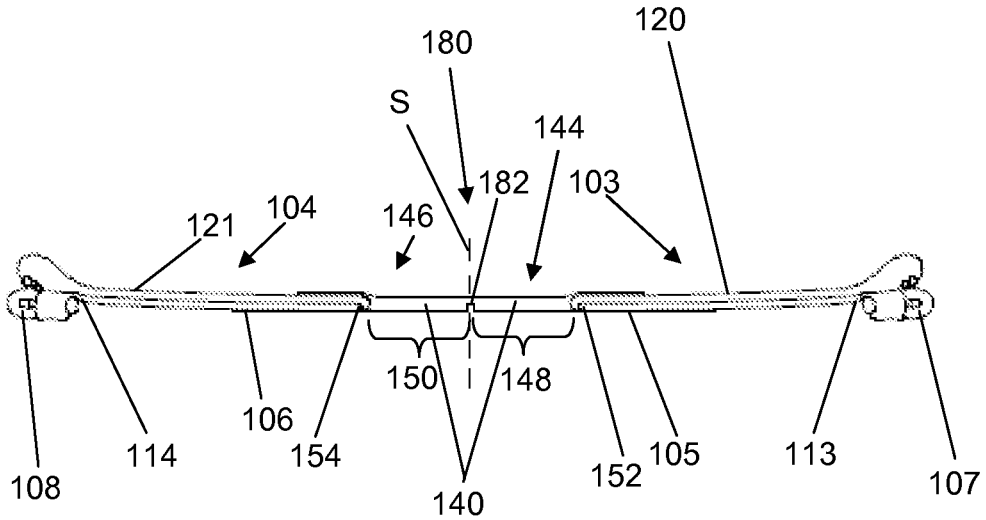
FIGS. 5 and 6 show a schematic cross-section through a portion of the slide fastener shown in FIG. 4, at an intermediate stage of manufacture.

Whereas FIG. 4 shows a chain 102 of a slide fastener 110 which has been assembled, FIG. 5 shows the stringers 103 and 104 of the chain 102 at an intermediate point part way through the manufacture of the chain 102.

Referring to FIG. 5, the extending layer 140 is attached both to the layer 120 (as previously discussed) and to the second layer 121. The extending layer 140 forms an extension member 180 which comprises a first overhang portion 148 which extends beyond a second edge 152 of the first tape 105 opposite the first edge 113 of the first tape 105 (again as previously discussed). The extension member 180 further includes a second overhang portion 150 which extends beyond a second edge 154 of the second tape 106 opposite the first edge end 114 of the second tape 106.

Again, the second layer 121 of fluid resistant material is attached to the second tape 106 and the extending layer 140 is attached to the second layer 121 such that there is no fluid path through the second layer 121 and/or extending layer 140 to the second tape 106.

In order for the stringers 103 and 104 shown within FIG. 5 to form the chain 102 shown in FIG. 4, the extension member 180 shown in FIG. 5 is separated at the point indicated by dashed line S so as to separate the extension member 180 into a first portion 144 and a second portion 146. The first portion 144 includes the first overhang portion 148 and the second portion 146 includes the second overhang portion 150. The first portion 144 of the extension member forms part of the first slide fastener stringer 103 and the second portion 146 of the extension member forms part of the second slide fastener stringer 104. The slide fastener stringers 103 and 104 can then be attached by the interdigitation of their respective coupling elements 107, 108 in order to form the chain 102 of the slide fastener 110.

The extension member 180 includes a groove 182. The groove 182 is located at the position on the extension member 180 at which the extension member 180 should be separated into the first and second portions 144, 146. The groove 182 acts as a score-line or line of structural weakness of the extension member and not only reduces the effort required to separate the extension member into the first and second portions, but also helps to ensure that the extension member is separated into first and second portions having the desired dimensions.

Although the method illustrated in FIG. 5 includes the manufacture of first and second stringers simultaneously, in other embodiments of the present invention, only one stringer may be manufactured at a time. Furthermore, in the method illustrated in FIG. 5 first and second stringers of the same chain are manufactured simultaneously. In other embodiments this need not be the case. For example, in some embodiments, two stringers manufactured according to the present invention may form part of different chains.

Figure 6:
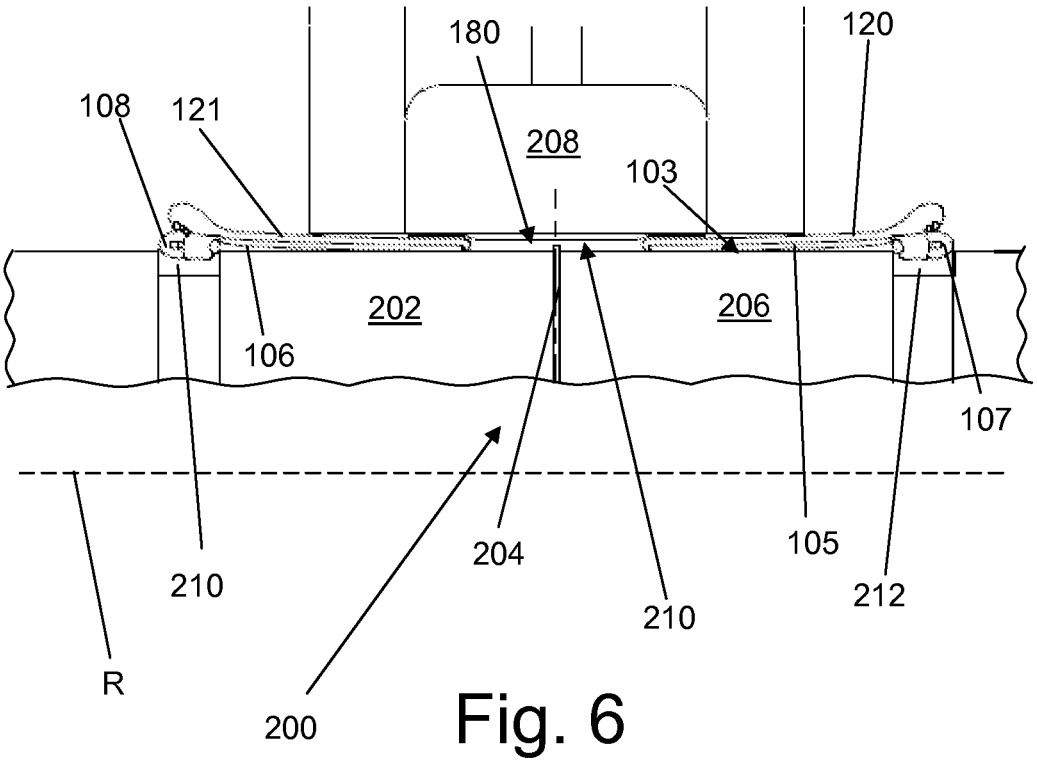

FIG. 6 shows a cross section through a portion of apparatus which may be used in order to carry out the portion of the method described in relation to FIG. 5.

The apparatus shown in FIG. 6 includes a roller 200 and a nozzle 208. The roller 200 includes a central ring 204 sandwiched between two outer rings 202 and 206. The outer rings each comprise a respective alignment groove 210 and 212. The roller 200 (and hence the outer rings 202, 206 and central ring 204) is generally cylindrical and rotates about an axis indicated schematically by R. The roller rotates about the axis R such that the axis R and cylinder axis of the generally cylindrical roller are substantially co-axial.

The diameter of the central ring 204 is greater than the diameter of the outer rings 202, 206. In this case, the diameter is measured relative to the cylinder axis of the generally cylindrical roller.

In use two tapes 105, 106, their respective coupling elements 107, 108 and attached first and second layers 120, 121 of fluid resistant material are fed between the roller 200 and nozzle 208. In some embodiments the roller 200 may drive the tapes 105, 106 (with their respective coupling elements and layers of fluid resistant material) between the roller 200 and nozzle 208. The tapes 105, 106 are correctly aligned with respect to the roller 200 (and hence nozzle 208) by the coupling elements 107, 108 being received by respective alignment grooves 212, 210 of the outer rollers 206, 202.

The nozzle 208 forms part of an extrusion die. The extending layer 180 is attached to the first and second layers 120, 121 by being extruded by the nozzle 208 onto and between the first layer 120 and second layer 121. The material extruded under pressure by the nozzle 208 of the extrusion die bonds to the first and second layers 120, 121. Any appropriate material may be extruded by the nozzle 208 of the extrusion dye, however, in this example, a thermoplastic is extruded by the nozzle 208. Examples of suitable thermo plastic material include polyurethane, polypropylene, polyvinyl chloride and rubber. However, we appreciated that any appropriate extruded material may be used.

As discussed, the extending layer 180 is extruded by the nozzle 208. The extending layer 180 is extruded into a void 220 defined between the edges of the first and second layers 120, 121, the surface of the rollers 202, 204, 206 and the nozzle 208.

Because the central roller 204 has a diameter which is greater than that of the outer rollers 202 and 206 the extending layer 180 extruded by the nozzle 208 includes a groove (182 in FIG. 5) which is defined by the central roller 204.

Although FIG. 6 shows an extending layer being extruded onto first and second layers 120, 121 of first and second tapes 105, 106, it will be appreciated that in other embodiments a similar apparatus may be used to apply an extending layer to only a single layer of fluid resistant material attached to a tape. Such an apparatus may include a roller as shown in FIG. 6, but with one of the outer rings omitted and a suitably modified nozzle. The inclusion of the inner ring, even when only extruding onto a single layer of fluid resistant material attached to a tape, may help to ensure that a uniform edge to the extension member is formed by the extruded extending layer.

It will be appreciated that numerous modifications to the above described method and apparatus may be made without departing from the scope of the invention as defined in the appended claims.

The described and illustrated embodiments are to be considered as illustrative and not restrictive in character, it being understood that only the preferred embodiments have been shown and described and that all changes and modifications that come within the scope of the inventions as defined in the claims are desired to be protected. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

The invention claimed is:

1. A method of manufacturing a portion of a slide fastener, the method comprising:

providing a first tape having a first edge;

providing the first tape with a row of coupling elements along the first edge of the first tape, the coupling elements being configured to interdigitate with a further row of coupling elements;

attaching a first layer of a fluid resistant material to the first tape;

attaching an extending layer of a fluid resistant material to the first layer, the extending layer forming an extension member comprising a first overhang portion which extends beyond a second edge of the first tape opposite the first edge of the first tape, wherein the first layer of the fluid resistant material is attached to the first tape and the extending layer is attached to the first layer such that there is no fluid path through the first layer and/or the extending layer to the first tape, wherein the first layer of the fluid resistant material is a layer of thermoplastic material which is extruded onto the first tape and the extending layer of the fluid resistant material is a thermoplastic material which is extruded onto the first layer at least at a position close to the second edge of the first tape, and wherein a back surface of the first tape is substantially flush with a back surface of the extending layer.

2. The method according to claim 1, wherein the first layer is attached to the first tape such that at least a portion of the first tape is sandwiched within the first layer.

3. The method according to claim 1, wherein the extending layer is attached to the first layer at a side opposite to the first tape so as to protrude relative to an upper surface of the first layer.

4. The method according to claim 1, wherein the extending layer is attached to the first layer such that at least a portion of the first layer is sandwiched within the extending layer.

5. The method according to claim 1, further comprising:

providing a second tape having a first edge;

providing the second tape with a row of coupling elements along the first edge of the second tape, the coupling elements being configured to interdigitate with a further row of coupling elements;

attaching a second layer of a liquid resistant material to the second tape; and attaching the extending layer to the second layer, the extending layer forming the extension member, the extension member comprising a second overhang portion which extends beyond a second edge of the second tape opposite the first edge of the second tape, wherein the second layer of the fluid resistant material is attached to the second tape and the extending layer is attached to the second layer such that there is no fluid path through the second layer and/or extending layer to the second tape and wherein the second layer of the fluid resistant material is a layer of thermoplastic material which is extruded onto the second tape and the extending layer of the fluid resistant material is a thermoplastic material which is extruded onto the second layer.

6. The method according to claim 5, wherein the further row of coupling elements with which the row of coupling elements along the first edge of the second tape is configured to interdigitate is the row of coupling elements along the first edge of the first tape.

7. The method according to claim 5, wherein the second layer is attached to the second tape such that at least a portion of the second tape is sandwiched within the second layer.

8. The method according to claim 5, wherein the extending layer is attached to the second layer at a side opposite to the second tape so as to protrude relative to an upper surface of the second layer.

9. The method according to claim 5, wherein the extending layer is attached to the second layer such that at least a portion of the second layer is sandwiched within the extending layer.

10. The method according to claim 5, wherein the second tape, and the second layer form part of a second stringer, the second stringer comprising a second sealing portion which is configured to, when the coupling elements of the second tape are interdigitated with the further row of coupling elements which form part of a further portion of the slide fastener, co-operate with a further sealing portion of the further portion of the slide fastener to form a fluid resistant seal which is configured to resist the passage of a fluid through the fluid resistant seal.

11. The method according to claim 5, further comprising:

separating the extension member into first and second portions, wherein the first portion includes the first overhang portion, and the second portion includes the second overhang portion.

12. A slide fastener including a portion manufactured according to the method as claimed in claim 1.

13. A slide fastener stringer configured to be sewn to a garment or other article with sewing threads, comprising:

a first tape having a row of coupling elements along a first edge of the first tape, the coupling elements being configured to interdigitate with a further row of coupling elements;

a first layer of a fluid resistant material attached to the first tape; and an extending layer of a fluid resistant material attached to the first layer, wherein the extending layer forms an extension member comprising a first overhang portion which extends beyond a second edge of the first tape opposite the first edge of the first tape;

wherein the first layer of the fluid resistant material is attached to the first tape and the extending layer is attached to the first layer such that there is no fluid path through the first layer and/or the extending layer to the first tape, and wherein the extending layer is made only of thermoplastic material, wherein a back surface of the first tape is substantially flush with a back surface of the extending layer, and wherein a dimension of the extending layer in a width direction of the slide fastener stringer is more than twice a thickness of the first tape.

14. The slide fastener stringer according to claim 13, wherein the first layer is attached to the first tape such that at least a portion of the first tape is sandwiched within the first layer.

15. The slide fastener stringer according to claim 13, wherein the extending layer is attached to the first layer such that at least a portion of the first layer is sandwiched within the extending layer.

16. A slide fastener comprising one or two stringers each of which corresponds to the slide fastener stringer according to claim 13.

17. A method of manufacturing a portion of a slide fastener configured to be sewn to a garment or other article with sewing threads, the method comprising:

providing a first tape having a first edge;

providing the first tape with a row of coupling elements along the first edge of the first tape, the coupling elements being configured to interdigitate with a further row of coupling elements;

attaching a first layer of a fluid resistant material to the first tape;

attaching an extending layer of a fluid resistant material to the first layer, the extending layer forming an extension member comprising a first overhang portion which extends beyond a second edge of the first tape opposite the first edge of the first tape; and sewing the first overhang portion to the garment or the other article with the sewing threads passing therethrough, wherein the first layer of the fluid resistant material is a layer of thermoplastic material which is extruded onto the first tape and the extending layer of the fluid resistant material is a thermoplastic material which is extruded onto the first layer at least at a position close to the second edge of the first tape, and wherein a back surface of the first tape is substantially flush with a back surface of the extending layer.

18. The method according to claim 17, wherein a waterproof backing material is attached to a portion of the first overhang portion, through which the sewing threads pass.

* * * * *